US006325868B1

(12) United States Patent
Kim et al.

(10) Patent No.: US 6,325,868 B1
(45) Date of Patent: Dec. 4, 2001

(54) NICKEL-BASED AMORPHOUS ALLOY COMPOSITIONS

(75) Inventors: Do Hyang Kim; Won Tae Kim; Sheng Hoon Yi, all of Seoul; Jin Kyu Lee, Kyungki-do; Min Ha Lee; Tae Gyu Park, both of Seoul; Ju Gun Park, Kyungsangnam-do; Hyun Kyu Lim; Jong Shim Jang, both of Seoul, all of (KR)

(73) Assignee: Yonsei University, Seoul (KR)

( * ) Notice: Subject to any disclaimer, the term of this patent is extended or adjusted under 35 U.S.C. 154(b) by 0 days.

(21) Appl. No.: 09/610,527

(22) Filed: Jul. 7, 2000

(30) Foreign Application Priority Data

Apr. 19, 2000 (KR) ..... 00-20587
May 29, 2000 (KR) ..... 00-28995

(51) Int. Cl.[7] ..... C22C 45/04
(52) U.S. Cl. ..... 148/403; 148/426; 420/441
(58) Field of Search ..... 148/304, 403, 148/409, 426; 420/441, 455

(56) References Cited

U.S. PATENT DOCUMENTS 5,288,344 * 2/1994 Peker et al. ..... 148/403
5,618,359 * 4/1997 Lin et al. ..... 148/403
5,735,975 * 4/1998 Lin et al. ..... 148/403
5,980,652 * 11/1999 Inoue et al. ..... 148/403
6,183,889 * 2/2001 Koshiba et al. ..... 148/304

FOREIGN PATENT DOCUMENTS 10-212561 * 8/1998 (JP) .

* cited by examiner

*Primary Examiner*—George Wyszomierski
(74) *Attorney, Agent, or Firm*—Rosenberg, Klein & Lee

(57) ABSTRACT

Disclosed are nickel-based amorphous alloy compositions, and particularly quaternary nickel-based amorphous alloy compositions containing nickel, zirconium and titanium as main constituent elements and additive Si or P, the quaternary nickel-zirconium-titanium-silicon alloy compositions comprising nickel in the range of 45 to 63 atomic %, zirconium plus titanium in the range of 32 to 48 atomic % and silicon in the range of 1 to 11 atomic %, and being represented by the general formula: $Ni_a(Zr_{1-x}Ti_x)_bSi_c$. Also, at least one kind of element selected from the group consisting of V, Cr, Mn, Cu, Co, W, Sn, Mo, Y, C, B, P, Al can be added to the alloy compositions in the range of content of 2 to 15 atomic %. The quaternary nickel-zirconium-titanium-phosphorus alloy compositions comprising nickel in the range of 50 to 62 atomic %, zirconium plus titanium in the range of 33 to 46 atomic % and phosphorus in the range of 3 to 8 atomic %, and being represented by the general formula: $Ni_d(Zr_{1-y}Ti_y)_eP_f$. The nickel-based amorphous alloy compositions have a superior amorphous phase-forming ability to produce the bulk amorphous alloy having a thickness of 1 mm by general casting methods.

13 Claims, 2 Drawing Sheets

NICKEL-BASED AMORPHOUS ALLOY COMPOSITIONS

BACKGROUND OF THE INVENTION

1. Field of the Invention

The present invention relates to nickel-based amorphous alloy compositions, and more particularly to nickel-based amorphous alloy compositions, each of which forms an amorphous phase having a supercooled liquid region of 20 K or larger when cooled from a liquid phase to a temperature below its glass transition temperature at a cooling rate of $10^6$ K/s or less.

2. Description of the Related Art

Most metal alloys form a crystalline phase having a regular atomic arrangement upon being solidified from a liquid phase. However, some alloys can maintain their irregular atomic structure of the liquid phase in a solid phase when the cooling rate applied to the solidification is high enough to limit nucleation and growth of the crystalline phase. These alloys are commonly called as amorphous alloys or metallic glasses.

Since the first report of amorphous phases in Au—Si system in 1960, many types of amorphous alloys have been invented and used in practice. Most, however, of these amorphous alloys require very high cooling rates to prevent the crystalline phase formation in the course of cooling from the liquid phase because the nucleation and growth of the crystalline phase progress rapidly in the supercooled liquid phase. Accordingly, most amorphous alloys could be produced only in the form of a thin ribbon having a thickness of about 80 $\mu$m or less, a fine wire having a diameter of about 150 $\mu$m or less, or a fine powder having a diameter of a few hundred $\mu$m or less by using rapid quenching techniques with the cooling rate in the range of $10^4$ to $10^6$ K/s. That is to say, practical applications of the amorphous alloys prepared by the rapid quenching techniques have been limited by the form and dimension thereof. Therefore, there has been a desire to develop alloys that require a lower critical cooling rate for avoiding the crystalline phase formation in the course of cooling from the liquid phase, that is, have a superior amorphous phase-forming ability so as to use the alloys in practice as common metal material.

If alloys have the superior amorphous phase-forming ability, it is possible to produce amorphous alloys in a bulk state by general casting methods. For example, in order to produce bulk amorphous alloys having a thickness of at least 1 mm, crystallization must be avoided even under the condition of a low cooling rate of $10^3$ K/s or less. For producing the bulk amorphous alloys, it is also important from an industrial point of view that the alloys have a large supercooled region in addition to the low cooling rate required for amorphous phase formation because viscous flow in the supercooled region makes it possible to mold the bulk amorphous alloys into industrial parts having specific shapes.

U.S. Pat. No. 5,288,344 and 5,735,975 disclose zirconium-based bulk amorphous alloys having the superior amorphous phase-forming ability, in which critical cooling rates required for amorphous phase formation are only a few K/s. Also, these zirconium-based bulk amorphous alloys are reported to have a large supercooled region, so that they are molded into and applied practically to structural materials. In fact, Zr—Ti—Cu—Ni—Be and Zr—Ti—Al—Ni—Cu alloys described in the specifications of the above patents are now used in practice as bulk amorphous products.

Considering, however, that zirconium is limitative in resources, has very high reactivity, includes impurities, and is very expensive, there has been a desire to develop bulk amorphous alloys containing a common metal, such as nickel, as a main constituent element which is more stable thermodynamically and more useful in industrial and economical standpoints.

Experimental results obtained from nickel-based amorphous ribbon show that nickel-based amorphous alloys have excellent corrosion resistances and strengths, which means that they can be applied to useful structural materials if only to be produced in the bulk state. A study reported in Materials Transactions, JIM, Vol. 40. No. 10, pp. 1130–1136 discloses that nickel-based bulk amorphous alloys having a maximum diameter of 1 mm can be fabricated in a Ni—Nb—Cr—Mo—P—B system by using a copper mold casting method, and these bulk amorphous alloys have comparatively large supercooled regions.

Nevertheless, for wider industrial applications of the nickel-based amorphous alloys, there is still a desire to develop new nickel-based bulk amorphous alloys that can be obtained in various alloy systems other than in the Ni—Nb—Cr—Mo—P—B system through proper alloy designs.

SUMMARY OF THE INVENTION

Accordingly, the present invention has been made to satisfy the above-mentioned desires, and it is an object of the present invention to provide new nickel-based bulk amorphous alloy compositions, which have excellent amorphous phase-forming abilities to allow the alloys to be produced by casting methods, and do not contain plenty of high vapor pressure-accompanying elements, such as phosphorus (P).

To achieve this object, there is provided a nickel-based amorphous alloy composition in accordance with a first embodiment of the present invention, the nickel-based amorphous alloy composition being represented by the following general formula:

$$Ni_a(Zr_{1-x}Ti_x)_bSi_c$$

where a, b and c are atomic percentages of nickel, zirconium plus titanium and silicon, respectively, and x is an atomic fraction of titanium to zirconium, wherein;

45 atomic %≦a≦63 atomic %, 32 atomic %≦b≦48 atomic %, 1 atomic %≦c≦11 atomic %, and 0.4≦x≦0.6.

In accordance with a second embodiment of the present invention, there is provided a nickel-based amorphous alloy composition being represented by the following general formula:

$$Ni_d(Zr_{1-y}Ti_y)_eP_f$$

where d, e and f are atomic percentages of nickel, zirconium plus titanium and phosphorus, respectively, and y is an atomic fraction of titanium to zirconium, wherein;

50 atomic %≦d≦62 atomic %, 33 atomic %≦e≦46 atomic %, 3 atomic %≦f≦8 atomic %, and 0.4≦y≦0.6.

For the design of the nickel-based amorphous alloy, the inventors have selected a ternary alloy of Ni (radius of an atom: 1.24 Å)-Ti (radius of an atom: 1.47 Å)-Zr (radius of an atom: 1. 60 Å) as a basic alloy system on the basis of empirical laws that the amorphous alloy tends to have a higher amorphous phase-forming ability when (1) the alloy has multi-element alloy composition of at least ternary alloy composition, (2) mutual differences of radius of an atom between alloy elements are larger than 10%, and (3) the alloy is composed of alloy elements having larger mutual bond energies therebetween. Further, considering that Si and P are known as elements capable of enhancing the amorphous phase-forming ability, the inventors try to improve the amorphous phase-forming ability by adding Si and P to the base alloy system.

The nickel-based amorphous alloy composition according to the first embodiment of the present invention includes the composition satisfying the ranges of: 44 atomic %≦a≦55 atomic %, 39 atomic %≦b≦47 atomic % and 5 atomic %≦c≦11 atomic %; or 56 atomic %≦a≦61 atomic %, 35 atomic %≦b≦40 atomic % and 2 atomic %≦c≦7 atomic %, and can form a bulk amorphous alloy having a thickness of 1 mm or more.

The nickel-based amorphous alloy composition according to the second embodiment of the present invention includes the composition satisfying the ranges of: 54 atomic %≦d≦58 atomic %, 37 atomic %≦e≦40 atomic % and 4 atomic %≦f≦7 atomic %, and can form a bulk amorphous alloy having a thickness of 1 mm or more.

In the nickel-based amorphous alloy composition according to the first aspect of the present invention, the ranges of content of Ni and Zr plus Ti with respect to the total composition are limited to 45 to 63 atomic % and 32 to 48%, respectively in order to enhance the amorphous phase-forming ability and to ensure a large supercooled region of 20 K or larger. Also, the range of additive content of Si with respect to the total composition is preferably 1 to 11 atomic % because the amorphous phase-forming ability is not sufficient if the additive content is less than 1 atomic %, and the amorphous phase-forming ability tends to be inversely reduced if the additive content is more than 11 atomic %.

In accordance with another embodiment of the present invention, there is provided a nickel-based amorphous alloy composition, in which at least one kind of element selected from the group consisting of V, Cr, Mn, Cu, Co, W, Sn, Mo, Y, C, B, P, Al is added to the alloy composition according to the first embodiment of the present invention in the range of content of 2 to 15 atomic % with respect to the total composition. The additive element is preferably Sn in the range of content of 2 to 5 atomic % which can form a bulk amorphous alloy having a thickness of 1 mm or more. Also, the preferred additive element is Mo or Y which can form a bulk amorphous alloy having a thickness of 1 mm or more when added in the range of content of 3 to 5 atomic %, respectively.

In the nickel-based amorphous alloy composition according to the second embodiment of the present invention, the ranges of content of Ni and Zr plus Ti with respect to the total composition are limited to 50 to 62 atomic % and 33 to 46%, respectively in order to enhance the amorphous phase-forming ability and to ensure a large supercooled region of 20 K or larger. Also, the range of additive content of P with respect to the total composition is preferably 3 to 8 atomic % because the amorphous phase-forming ability is not sufficient if the additive content is less than 3 atomic %, and the amorphous phase-forming ability tends to be inversely reduced if the additive content is more than 8 atomic %.

The nickel-based amorphous alloys according to the present invention may be manufactured by means of rapid quenching methods, mold casting methods, high-pressure casting methods, and preferably atomizing methods.

Also, since the nickel-based amorphous alloys according to the present invention have good hot workability, the amorphous alloys may be manufactured through forging, rolling, drawing or other hot working processes.

Further, the nickel-based amorphous alloys according to the present invention may be manufactured as a composite material that contains a first amorphous phase as a base and a second phase of a nanometer or micrometer unit.

The nickel-based amorphous alloy compositions according to the present invention solidify as a completely amorphous phase when cooled from a liquid phase at a cooling rate of $10^6$ K/s or less, and have a glass transition temperature of 773 K or above and a supercooled liquid region of 20 K or larger ($\Delta T = T_x$ (crystallization temperature)$-T_g$ (glass transition temperature)). Particularly, the nickel-based amorphous alloy compositions according to the present invention include compositions which have a glass transition temperature of 823 K or above, a supercooled liquid region of 0 to 50 K or larger and thus superior amorphous phase-forming ability to those of the conventional nickel-based amorphous alloys, which makes it possible to produce a bulk amorphous alloy having a thickness of 1 mm by means of a copper mold casting method.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Hereinafter, preferred embodiments of the present invention will be described with reference to the accompanying drawings. Since these embodiments are given only for the purpose of description, it will be apparent by those skilled in the art that the present invention is not limited to these embodiments.

Figure 1:
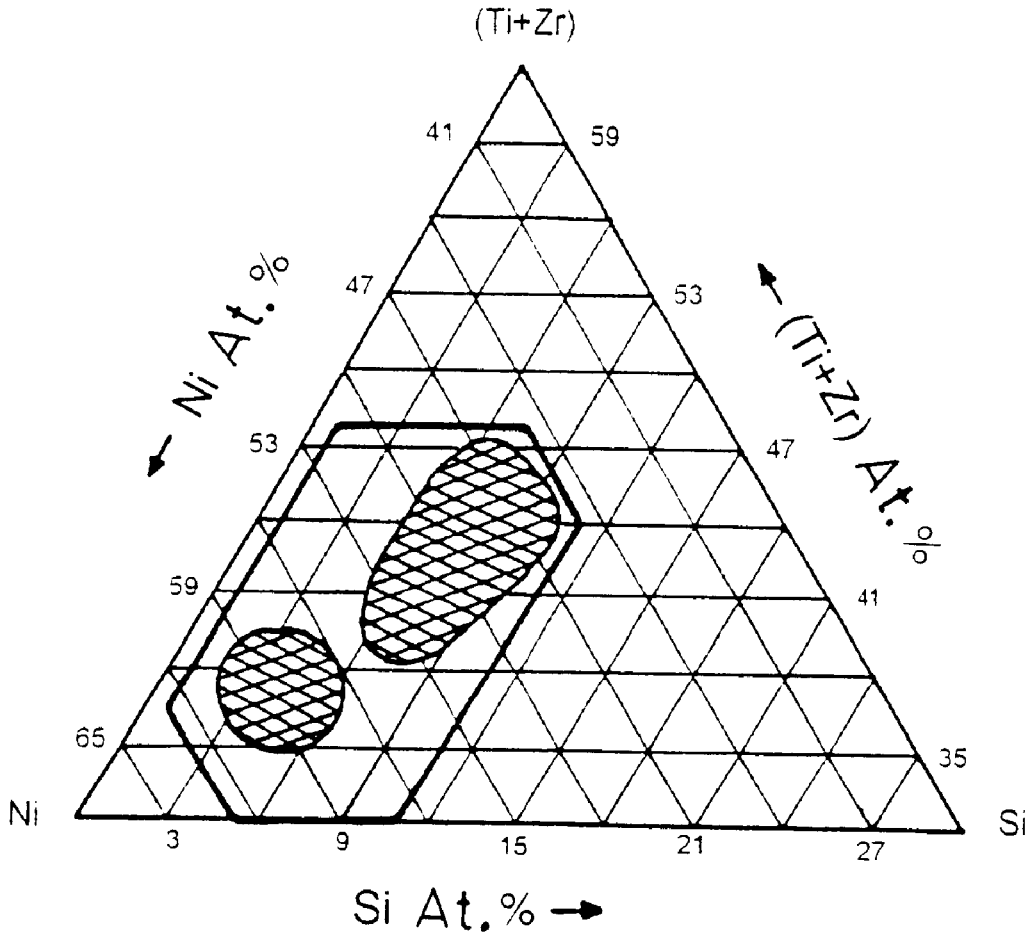
FIG. 1 is a quasi-ternary composition diagram showing a composition range of a nickel-zirconium-titanium-silicon alloy according to a first embodiment of the present invention.
Figure 2:
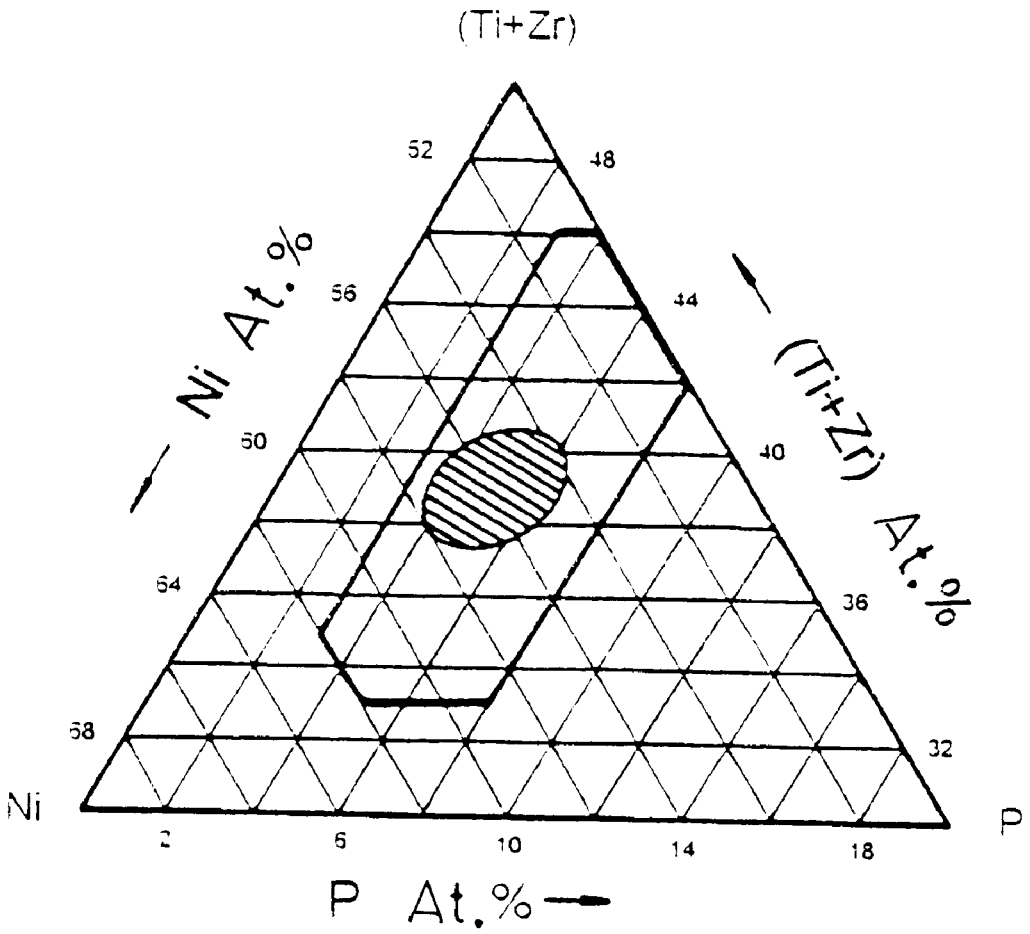
FIG. 2 is a quasi-ternary composition diagram showing a composition range of a nickel-zirconium-titanium-phosphorus alloy according to a second embodiment of the present invention.

FIGS. 1 and 2 illustrate composition ranges of nickel-based amorphous alloys according to a first and a second embodiment of the present invention in a quasi-ternary composition diagram, respectively. FIG. 1 shows a composition of a zirconium-titanium-silicon alloy, and FIG. 2 shows a composition of a nickel-zirconium-titanium-phosphorus alloy. As expressed in the above general formulas, the ratio of zirconium to titanium is 0.6 to 0.4: 0.4 to 0.6.

A composition region shown by a thick solid line in FIG. 1 is one that forms an amorphous phase upon being cooled from a liquid phase at a cooling rate of $10^6$ K/s or less, and has a supercooled region of 20 K or larger. Particularly, in the composition ranges of: 44 atomic %≦a≦55 atomic %, 39 atomic %≦b≦47 atomic % and 5 atomic %≦c≦11 atomic %; or 56 atomic %≦a≦61 atomic %, 35 atomic %≦b≦40 atomic % and 2 atomic %≦c≦7 atomic %, the alloy composition has a glass transition temperature of 823 K or above, and a supercooled liquid region of 50 K or larger, which makes it possible to produce a bulk amorphous alloy having a thickness of 1 mm at a cooling rate of $10^3$ K/s or less. These composition regions are shown using an oblique line in FIG. 1.

On the other hand, there is provided a nickel-based amorphous alloy composition, in which at least one kind of element selected from the group consisting of V, Cr, Mn, Cu, Co, W, Sn, Mo, Y, C, B, P, Al is added to the alloy composition according to the first embodiment of the present invention in the range of content of 2 to 15 atomic % with respect to the total composition. This alloy composition forms an amorphous phase upon being cooled from a liquid phase at a cooling rate of $10^6$ K/s or less, and has a supercooled region of 20 K or larger. Particularly, in the case of adding Sn in the range of content of 2 to 5 atomic %, the alloy composition has a supercooled liquid region of 50 K or larger, which makes it possible to produce the bulk amorphous alloy having a thickness of 1 mm at a cooling rate of $10^3$ K/s or less. Also, in the case of adding Mo or V in the range of content of 3 to 5 atomic %, the alloy composition has a supercooled liquid region of 60 K or larger, which makes it possible to produce the bulk amorphous alloy having a thickness of 1 mm at a cooling rate of $10^3$ K/s or less.

A composition region shown by a thick solid line in FIG. 2 is one that forms an amorphous phase upon being cooled from a liquid phase at a cooling rate of $10^6$ K/s or less, and has a supercooled region of 20 K or larger. Particularly, in the composition ranges of 54 atomic %≦d≦58 atomic %, 37 atomic % ≦e≦40 atomic % and 4 atomic %≦f≦6 atomic %, the alloy composition has a glass transition temperature of 823 K or above, and a supercooled liquid region of 40 K or larger, which makes it possible to produce the bulk amorphous alloy having a thickness of 1 mm at a cooling rate of $10^3$ K/s or less. These composition regions are shown using an oblique line in FIG. 2.

The nickel-based amorphous alloys according to the present invention have an excellent amorphous phase-forming ability, and so can be manufactured by means of various types of rapid quenching methods including a single roll melt spinning, twin roll melt spinning, a gas atomizing and the like. Some of the alloy compositions according to the present invention can be produced as the bulk amorphous alloy at a cooling rate of $10^3$ K/s or less. As a method for producing the bulk amorphous alloy, a mold casing method, a molten melt forging method, etc. can be enumerated.

As seen from the above, an advantage of the present invention is that a larger supercooled liquid region of 40 to 50 K or larger can be obtained to ensure a superior workability by the present invention, so that plate-, rod- or other-shaped bulk amorphous alloys can be produced by means of general casing methods, and then the bulk amorphous alloys can be easily molded into specific shapes of parts using viscous flow in the supercooled region. Moreover, it is possible to produce amorphous powder using the nickel-based amorphous alloys of the present invention by an atomizing method or a mechanical alloying method, and then to mold preformed bodies of the amorphous powder into bulk amorphous parts by applying a high pressure at a high temperature of the supercooled liquid region while maintaining the amorphous structure.

EXAMPLE 1

After an alloy having a composition given in Table 1 was melted in a quartz tube by an arc melting method, the molten alloy was ejected onto a copper wheel rotating at a speed of 3200 rpm through a nozzle having a diameter of about 1 mm to obtain a nickel-based amorphous alloy ribbon having a thickness of 40 $\mu$m. This alloy sample so obtained by the single roll melt spinning method was tested by an X-ray diffraction analysis. As the result of the analysis, the alloy sample was identified as being in amorphous phase by the fact that the sample exhibited a halo-shaped diffraction peak. A glass transition temperature ($T_g$), a crystallization temperature ($T_x$) and an exothermic enthalpy during the crystallization were measured by a differential scanning calorimetric analysis, results of which are shown in Table 1. Also, a temperature width ($\Delta T$) of a supercooled liquid region was determined as a difference ($T_x$–$T_g$) between the glass transition temperature ($T_g$) and the crystallization temperature ($T_x$), results of which are also shown in Table 1.

TABLE 1

| Sample No. | Alloy composition | $T_g$ (° C.) | $T_x$ (° C.) | $\Delta T$ | $\Delta H$ (J/g) |
|---|---|---|---|---|---|
| 1 | $Ni_{51}Zr_{20}Ti_{26}Si_3$ | 522.9 | 548.4 | 25.5 | 68.1 |
| 2 | $Ni_{53}Zr_{20}Ti_{24}Si_3$ | 530.6 | 556.6 | 26 | 74 |
| 3 | $Ni_{55}Zr_{20}Ti_{22}Si_3$ | 542.5 | 581.9 | 39.4 | 70.7 |
| 4 | $Ni_{59}Zr_{20}Ti_{18}Si_3$ | 556.5 | 608.8 | 52.3 | 63.2 |
| 5 | $Ni_{61}Zr_{20}Ti_{16}Si_3$ | 568.7 | 613.4 | 44.7 | 51 |
| 6 | $Ni_{63}Zr_{20}Ti_{14}Si_3$ | 575.7 | 607.4 | 31.7 | 42.6 |
| 7 | $Ni_{51}Zr_{20}Ti_{24}Si_5$ | 536.7 | 576.7 | 40 | 85.4 |
| 8 | $Ni_{53}Zr_{20}Ti_{22}Si_5$ | 546.2 | 592.4 | 46.2 | 72.9 |
| 9 | $Ni_{55}Zr_{20}Ti_{20}Si_5$ | 557.7 | 602.4 | 44.7 | 59.2 |
| 10 | $Ni_{59}Zr_{20}Ti_{16}Si_5$ | 569.4 | 624.5 | 55.1 | 39.5 |
| 11 | $Ni_{61}Zr_{20}Ti_{14}Si_5$ | 576.6 | 620.5 | 43.9 | 39.2 |
| 12 | $Ni_{51}Zr_{20}Ti_{22}Si_7$ | 558.5 | 608.6 | 50.1 | 60.6 |
| 13 | $Ni_{53}Zr_{20}Ti_{20}Si_7$ | 563.5 | 613 | 49.5 | 68.8 |
| 14 | $Ni_{55}Zr_{20}Ti_{18}Si_7$ | 568.9 | 617.1 | 48.2 | 60.1 |
| 15 | $Ni_{51}Zr_{20}Ti_{20}Si_9$ | 570.3 | 617.2 | 46.9 | 67.9 |

After an alloy having a composition given in Table 2 was melted in a quartz tube by an arc melting method, the molten alloy was injected into a copper mold provide with a cavity having a diameter of 1 to 5 mm and a height of 50 mm through a nozzle having a diameter of about 1 mm to obtain a nickel-based amorphous alloy cylinder having a diameter of 1 to 5 mm and a height of 45 to 50 mm. This alloy sample so obtained by the copper mold casting method was tested by an X-ray diffraction analysis. As the result of the analysis, the alloy sample was identified as being an amorphous phase by the fact that the sample exhibited a halo-shaped diffraction peak. A glass transition temperature ($T_g$), a crystallization temperature ($T_x$) and an exothermic enthalpy during the crystallization were measured by a differential scanning calorimetric analysis, results of which are shown in Table 2. Also, a temperature width ($\Delta T$) of a supercooled liquid region was determined as a difference ($T_x$–$T_g$) between the glass transition temperature ($T_g$) and the crystallization temperature ($T_x$), results of which are also shown in Table 2.

TABLE 2

| Sample No. | Alloy composition | $T_x$ (° C.) | $T_g$ (° C.) | $\Delta T$ | $\Delta H$ (J/g) |
|---|---|---|---|---|---|
| 1 | $Ni_{57}Zr_{20}Ti_{15}Si_3V_3$ | 605.63 | 572.113 | 33.517 | −32.252 |
| 2 | $Ni_{57}Zr_{20}Ti_{12}Si_5V_6$ | 603.888 | 559.736 | 44.152 | −20.341 |
| 3 | $Ni_{57}Zr_{20}Ti_{19}Si_5V_9$ | | | | |
| 4 | $Ni_{57}Zr_{20}Ti_3Si_5V_5$ | | | | |
| 5 | $Ni_{57}Zr_{20}Ti_{18}Si_3V_2$ | 601.817 | 566.482 | 35.335 | −57.156 |
| 6 | $Ni_{57}Zr_{20}Ti_{15}Si_5Cr_3$ | 593.205 | 546.087 | 47.118 | −21.462 |
| 7 | $Ni_{57}Zr_{20}Ti_{12}Si_5Cr_6$ | | | | |
| 8 | $Ni_{57}Zr_{20}Ti_9Si_5Cr_9$ | | | | |
| 9 | $Ni_{57}Zr_{20}Ti_3Si_5Cr_{15}$ | | | | |
| 10 | $Ni_{57}Zr_{20}Ti_{18}Si_3Cr_2$ | | | | |
| 11 | $Ni_{57}Zr_{20}Ti_{15}Si_5Mn_3$ | 601.558 | 564.608 | 36.95 | −31.42 |
| 12 | $Ni_{57}Zr_{20}Ti_{12}Si_5Mn_6$ | 587.519 | 553.793 | 33.726 | −29.02 |
| 13 | $Ni_{57}Zr_{20}Ti_{19}Si_5Mn_9$ | | | | |

TABLE 2-continued

| Sample No. | Alloy composition | $T_x$ (° C.) | $T_g$ (° C.) | ΔT | ΔH (J/g) |
|---|---|---|---|---|---|
| 14 | $Ni_{57}Zr_{20}Ti_3Si_5Mn_{15}$ | | | | |
| 15 | $Ni_{57}Zr_{20}Ti_{18}Si_3Mn_2$ | 599.738 | 553.859 | 45.879 | −60.33 |
| 16 | $Ni_{57}Zr_{20}Ti_{15}Si_5Cu_3$ | 621.598 | 580.649 | 40.949 | −36.027 |
| 17 | $Ni_{57}Zr_{20}Ti_{12}Si_5Cu_6$ | 600.272 | 577.105 | 23.167 | −59.115 |
| 18 | $Ni_{57}Zr_{20}Ti_9Si_5Cu_9$ | | | | |
| 19 | $Ni_{57}Zr_{20}Ti_3Si_5Cu_{15}$ | | | | |
| 20 | $Ni_{57}Zr_{20}Ti_{18}Si_3Cu_2$ | 605.495 | 557.974 | 47.521 | −58.824 |
| 21 | $Ni_{57}Zr_{20}Ti_{18}Si_3Co_2$ | 610.684 | 569.363 | 41.321 | −52.642 |
| 22 | $Ni_{57}Zr_{20}Ti_{15}Si_5Co_3$ | 619.456 | 578.863 | 40.593 | −40.034 |
| 23 | $Ni_{57}Zr_{20}Ti_{12}Si_5Co_6$ | | | | |
| 24 | $Ni_{57}Zr_{20}Ti_9Si_3Co_9$ | | | | |
| 25 | $Ni_{57}Zr_{20}Ti_{18}Si_3W_2$ | 607.958 | 566.878 | 41.08 | −61.962 |
| 26 | $Ni_{57}Zr_{20}Ti_{15}Si_5W_3$ | 625.844 | 577.724 | 48.12 | −39.033 |
| 27 | $Ni_{57}Zr_{20}Ti_{12}Si_5W_6$ | 625.399 | 585.526 | 39.873 | −36.004 |
| 28 | $Ni_{57}Zr_{20}Ti_9Si_5W_9$ | | | | |
| 29 | $Ni_{57}Zr_{20}Ti_{18}Si_3Sn_2$ | 623.552 | 569.459 | 54.093 | −60.087 |
| 30 | $Ni_{57}Zr_{20}Ti_{15}Si_5Sn_3$ | 639.25 | 588.111 | 51.139 | −49.758 |
| 31 | $Ni_{57}Zr_{20}Ti_{12}Si_5Sn_6$ | 633.478 | 587.634 | 45.844 | −44.176 |
| 32 | $Ni_{57}Zr_{20}Ti_9Si_5Sn_9$ | | | | |
| 33 | $Ni_{57}Zr_{20}Ti_{18}Si_3Mo_2$ | 603.849 | 560.935 | 42.914 | −47.374 |
| 34 | $Ni_{57}Zr_{20}Ti_{15}Si_5Mo_3$ | 614.086 | 549.524 | 64.562 | −27.236 |
| 35 | $Ni_{57}Zr_{20}Ti_{12}Si_5Mo_6$ | | | | |
| 36 | $Ni_{57}Zr_{20}Ti_9Si_5Mo_9$ | | | | |
| 37 | $Ni_{57}Zr_{20}Ti_{18}Si_3Y_2$ | 565.129 | 531.714 | 33.415 | −68.547 |
| 38 | $Ni_{57}Zr_{20}Ti_{15}Si_5Y_3$ | 601.766 | 541.546 | 60.22 | −62.216 |
| 39 | $Ni_{57}Zr_{20}Ti_{12}Si_5Y_6$ | | | | |
| 40 | $Ni_{57}Zr_{20}Ti_9Si_5Y_9$ | 537.92 | 492.654 | 45.275 | −46.748 |
| 41 | $Ni_{57}Zr_{20}Ti_{17.5}Si_5C_{0.5}$ | 625.221 | 581.28 | 43.941 | −56.447 |
| 42 | $Ni_{57}Zr_{20}Ti_{17}Si_5C_1$ | 624.85 | 588.809 | 36.041 | −38.445 |
| 43 | $Ni_{57}Zr_{20}Ti_{16}Si_5C_2$ | 617.498 | 590.138 | 27.36 | −31.775 |
| 44 | $Ni_{57}Zr_{20}Ti_{15}Si_5C_3$ | | | | |
| 45 | $Ni_{57}Zr_{20}Ti_{17.5}Si_5B_{0.5}$ | 621.154 | 578.478 | 42.676 | −57.979 |
| 46 | $Ni_{57}Zr_{20}Ti_{17}Si_5B_1$ | 620.616 | 575.491 | 45.125 | −61.945 |
| 47 | $Ni_{57}Zr_{20}Ti_{16}Si_5B_2$ | 617.019 | 577.481 | 39.538 | −65.567 |
| 48 | $Ni_{57}Zr_{20}Ti_{15}Si_5B_3$ | 618.959 | 580.417 | 38.542 | −73.549 |
| 49 | $Ni_{57}Zr_{20}Ti_{13}Si_5P_5$ | | | | |
| 50 | $Ni_{57}Zr_{20}Ti_8Si_5P_{10}$ | | | | |
| 51 | $Ni_{57}Zr_{20}Ti_7Si_5P_{15}$ | | | | |
| 52 | $Ni_{57}Zr_{20}Ti_3Si_5P_{15}$ | | | | |
| 53 | $Ni_{57}Zr_{20}Ti_{13}Si_5Al_5$ | 618.322 | 578.008 | 40.314 | −48.453 |
| 54 | $Ni_{57}Zr_{20}Ti_8Si_5Al_{10}$ | | | | |
| 55 | $Ni_{57}Zr_{20}Ti_3Si_5Al_{15}$ | | | | |
| 56 | $Ni_{57}Zr_{20}Ti_3Si_5Al_{15}$ | | | | |

Generally, increasing of the supercooled liquid region means that the critical cooling rate required for the amorphous formation grows lower, and that hot forming works can be easily performed using the viscous flow of the amorphous alloy. In this point of view, the amorphous alloy compositions according to the first embodiment of the present invention are worthy of notice because they have the supercooled liquid region of 50 K or larger as shown in Table 1.

EXAMPLE 3

After an alloy having a composition given in Table 3 was melted in a quartz tube by an arc melting method, the molten alloy was ejected onto a copper wheel rotating at a speed of 3200 rpm through a nozzle having a diameter of about 1 mm to obtain a nickel-based amorphous alloy ribbon having a thickness of 50 $\mu$m. This alloy sample so obtained by the single roll melt spinning method was tested by an X-ray diffraction analysis. As the result of the analysis, the alloy sample was identified as being in amorphous phase by the fact that the sample exhibited a halo-shaped diffraction peak. A glass transition temperature ($T_g$), a crystallization temperature ($T_x$) and an exothermic enthalpy during the crystallization were measured by a differential scanning calorimetric analysis, results of which are shown in Table 3. Also, a temperature width (ΔT) of a supercooled liquid region was determined as a difference ($T_x$–$T_g$) between the glass transition temperature ($T_g$) and the crystallization temperature ($T_x$), results of which are also shown in Table 3.

The results shown in Table 3 indicate that the amorphous alloy compositions according to the second embodiment of the present invention have a larger supercooled liquid region of 20 K or larger, and particularly the amorphous alloy compositions designated by sample No. 2, 7, 8, 11 and 14 have a much larger supercooled liquid region of 40 K or larger, which leads to a superior amorphous phase-forming ability and an excellent hot workability.

TABLE 3

| Sample No. | Alloy composition | $T_g$ (° C.) | $T_x$ (° C.) | ΔT | ΔH (J/g) |
|---|---|---|---|---|---|
| 1 | $Ni_{55}Zr_{20}Ti_{21}P_4$ | 568.8 | 607.4 | 38.6 | 47.6 |
| 2 | $Ni_{57}Zr_{20}Ti_{19}P_4$ | 577.5 | 620.7 | 43.2 | 51.4 |
| 3 | $Ni_{59}Zr_{20}Ti_{17}P_4$ | 590.4 | 627.7 | 37.3 | 59.0 |
| 4 | $Ni_{61}Zr_{20}Ti_{15}P_4$ | 591.1 | 626.8 | 35.7 | 58.4 |
| 5 | $Ni_{51}Zr_{20}Ti_{24}P_5$ | 567.4 | 597.4 | 30.0 | 54.4 |
| 6 | $Ni_{53}Zr_{20}Ti_{22}P_5$ | 571.5 | 607.2 | 35.7 | 47.9 |
| 7 | $Ni_{55}Zr_{20}Ti_{20}P_5$ | 579.3 | 622.2 | 42.9 | 44.1 |
| 8 | $Ni_{57}Zr_{20}Ti_{18}P_5$ | 583.8 | 630.0 | 46.2 | 54.5 |
| 9 | $Ni_{59}Zr_{20}Ti_{16}P_5$ | 593.0 | 628.8 | 35.8 | 59.5 |
| 10 | $Ni_{61}Zr_{20}Ti_{14}P_5$ | 599.9 | 626.6 | 26.7 | 69.1 |
| 11 | $Ni_{55}Zr_{20}Ti_{19}P_6$ | 588.0 | 631.1 | 43.1 | 42.1 |
| 12 | $Ni_{57}Zr_{20}Ti_{17}P_6$ | 597.7 | 632.3 | 34.6 | 57.6 |
| 13 | $Ni_{59}Zr_{20}Ti_{15}P_6$ | 599.4 | 631.6 | 32.2 | 60.3 |
| 14 | $Ni_{55}Zr_{20}Ti_{18}P_7$ | 595.6 | 636.4 | 40.8 | 55.2 |
| 15 | $Ni_{57}Zr_{20}Ti_{16}P_7$ | 604.1 | 634.8 | 30.7 | 58.4 |

As described above, the nickel-based amorphous alloy compositions have a high strength, a good abrasion resistance and a superior corrosion resistance, so that they can easily form the bulk amorphous alloys and the bulk amorphous alloys can be applied to high strength and abrasion resistance parts, structural materials, and welding and coating materials.

While the present invention has been illustrated and described under considering preferred specific embodiments thereof, it will be easily understood by those skilled in the art that the present invention is not limited to the specific embodiments, and various changes and modifications and equivalents may be made without departing from the true scope of the present invention.

What is claimed is:

1. A nickel-based amorphous alloy composition being represented by the following general formula:

$$Ni_a(Zr_{1-x}Ti_x)_bSi_c$$

where a, b and c are atomic percentages of nickel, zirconium plus titanium and silicon, respectively, and x is an atomic fraction of titanium to the total of titanium and zirconium, wherein;

45 atomic %≦a≦63 atomic %, 32 atomic %≦b≦48 atomic %, 1 atomic %≦c≦11 atomic %, and 0.4 ≦x≦0.6.

2. A nickel-based amorphous alloy composition as recited in claim 1, wherein a, b and c are in the ranges of 44 atomic %≦a≦55 atomic %, 39 atomic %≦b≦47 atomic % and 5 atomic %≦c≦11 atomic %, respectively.

3. A nickel-based amorphous alloy composition as recited in claim 1, wherein a, b and c are in the ranges of 56 atomic %≦a≦61 atomic %, 35 atomic %≦b≦40 atomic % and 2 atomic %≦c≦7 atomic %, respectively.

4. A nickel-based amorphous alloy composition as recited in claim 1, further comprising at least one additive element selected from the group consisting of V, Cr, Mn, Cu, Co, W, Sn, Mo, Y, C, B, P, Al in the range of content of 2 to 15 atomic %.

5. A nickel-based amorphous alloy composition as recited in claim 4, wherein the additive element is Sn in the range of content of 2 to 5 atomic %.

6. A nickel-based amorphous alloy composition as recited in claim 4, wherein the additive element is Mo or Y in the range of content of 3 to 5 atomic %.

7. A nickel-based amorphous alloy composition being represented by the following general formula:

$$Ni_d(Zr_{1-y}Ti_y)_eP_f$$

where d, e and f are atomic percentages of nickel, zirconium plus titanium and phosphorus, respectively, and y is an atomic fraction of titanium to the total of titanium and zirconium, wherein;

50 atomic %≦d≦62 atomic %, 33 atomic %≦e≦46 atomic %, 3 atomic %≦f≦8 atomic %, and 0.4 ≦y≦0.6.

8. A nickel-based amorphous alloy composition as recited in claim 7, wherein d, e and f are in the ranges of 54 atomic %≦d≦58 atomic %, 37 atomic %≦e≦40 atomic % and 4 atomic %≦f≦7 atomic %.

9. A nickel-based amorphous alloy composition as recited in claim 7, wherein d is 57 atomic %, e is 39 atomic %, f is 4 atomic %, and y is 0.4872.

10. A nickel-based amorphous alloy composition as recited in claim 7, wherein d is 55 atomic %, e is 40 atomic %, f is 5 atomic %, and y is 0.5.

11. A nickel-based amorphous alloy composition as recited in claim 7, wherein d is 57 atomic %, e is 38 atomic %, f is 5 atomic %, and y is 0.4737.

12. A nickel-based amorphous alloy composition as recited in claim 7, wherein d is 55 atomic %, e is 39 atomic %, f is 6 atomic %, and y is 0.4872.

13. A nickel-based amorphous alloy composition as recited in claim 7, wherein d is 55 atomic %, e is 38 atomic %, f is 7 atomic %, and y is 0.4737.

* * * * *